US011871847B2

(12) United States Patent
Murphy et al.

(10) Patent No.: US 11,871,847 B2
(45) **Date of Patent: *Jan. 16, 2024**

(54) STORAGE RACK GUARD DROP-IN BRACKET

(71) Applicant: SpaceGuard Products, Inc., Seymour, IN (US)

(72) Inventors: Edward M. Murphy, Columbus, IN (US); Scott A Jump, North Vernon, IN (US); Christopher Lee Roberts, Seymour, IN (US)

(73) Assignee: SpaceGuard Products, Inc., Seymour, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/146,770

(22) Filed: Dec. 27, 2022

(65) Prior Publication Data

US 2023/0137022 A1 May 4, 2023

Related U.S. Application Data

(63) Continuation of application No. 17/327,095, filed on May 21, 2021, now Pat. No. 11,564,491, which is a (Continued)

(51) Int. Cl.

| | |
|---|---|
| ***A47B 96/06*** | (2006.01) |
| ***A47B 57/22*** | (2006.01) |
| ***A47B 96/20*** | (2006.01) |

(52) U.S. Cl.

CPC ..... *A47B 96/06* (2013.01); *A47B 57/22* (2013.01); *A47B 96/20* (2013.01)

(58) Field of Classification Search

CPC ..... A47B 96/06; A47B 96/20; A47B 57/48; A47B 57/50; A47B 57/22; A47B 57/487

See application file for complete search history.

(56) References Cited

U.S. PATENT DOCUMENTS

| | | | |
|---|---|---|---|
| 2,104,831 | A | 1/1938 | Martin |
| 2,157,309 | A | 5/1939 | Enoch et al. |

(Continued)

FOREIGN PATENT DOCUMENTS

| | | | |
|---|---|---|---|
| CN | 1435144 | A | 8/2003 |
| CN | 1603639 | A | 4/2005 |

(Continued)

OTHER PUBLICATIONS

PCT/US2016/068524 , "Application Serial No. PCT/US2016/068524, International Search Report and Written Opinion dated Mar. 17, 2017", SpaceGuard Products, Inc., 26 Pages.

(Continued)

*Primary Examiner* — Stanton L Krycinski

(74) *Attorney, Agent, or Firm* — GTC Law Group PC & Affiliates

(57) ABSTRACT

An apparatus including a bracket, an upper rack engagement tab, a lower rack engagement tab; and a lock pin hole. The bracket has a rack attachment member and a guard attachment member. The lock pin hole is defined by the rack attachment member and structured to receive a lock pin having a stabilizing leg coupled to a lock pin head. Each engagement tab is coupled to the rack attachment member. Each engagement tab includes a stem portion coupled to the rack attachment member and a head portion having a greater cross-sectional area than the stem portion. The guard attachment member defines a guard attachment hole positioned at a rack guard spacing distance from the rack attachment member, and the stabilizing leg has a geometry such that the lock pin head is urged toward the lock pin hole when the stabilizing leg is passed through the lock pin hole.

20 Claims, 5 Drawing Sheets

Related U.S. Application Data continuation of application No. 16/448,948, filed on Jun. 21, 2019, now Pat. No. 11,033,105, which is a continuation of application No. PCT/US2016/068524, filed on Dec. 23, 2016.

(56) References Cited

U.S. PATENT DOCUMENTS

| | | | |
|---|---|---|---|
| 3,042,221 | A | 7/1962 | Rasmussen |
| 3,070,237 | A | 12/1962 | Fullerton et al. |
| 3,144,944 | A | 8/1964 | Kennedy |
| 3,337,062 | A | 8/1967 | Seiz |
| 3,352,584 | A | 11/1967 | Teofil et al. |
| 3,392,848 | A | 7/1968 | Kennedy et al. |
| 3,512,653 | A | 5/1970 | Erismann |
| 3,545,626 | A | 12/1970 | Seiz |
| 3,572,263 | A | 3/1971 | Propst |
| 3,702,137 | A | 11/1972 | Evans |
| 3,741,405 | A | 6/1973 | Mc et al. |
| 3,877,579 | A | 4/1975 | Weider |
| 4,131,204 | A | 12/1978 | Jacoby et al. |
| 4,212,638 | A | 7/1980 | Korn |
| 4,262,809 | A | 4/1981 | Mcconnell |
| 4,382,518 | A | 5/1983 | Bondoux |
| 4,423,817 | A | 1/1984 | Monjo-Rufi |
| D327,214 | S | 6/1992 | Stuart |
| 5,188,326 | A | 2/1993 | Zich |
| 5,349,909 | A | 9/1994 | Smit et al. |
| D357,400 | S | 4/1995 | Sachs |
| 5,624,045 | A | 4/1997 | Highsmith et al. |
| 5,791,502 | A | 8/1998 | Bietz et al. |
| 5,845,795 | A | 12/1998 | Mulholland |
| D408,266 | S | 4/1999 | Santiago |
| 5,938,367 | A | 8/1999 | Olson |
| D420,278 | S | 2/2000 | Coffey et al. |
| D422,886 | S | 4/2000 | Shea |
| D432,901 | S | 10/2000 | Mcdonald |
| 6,155,441 | A | 12/2000 | Andersen et al. |
| 6,196,141 | B1 | 3/2001 | Herron et al. |
| 6,202,570 | B1 | 3/2001 | Kurtsman |
| 6,230,910 | B1 | 5/2001 | Olsson et al. |
| 6,273,534 | B1 | 8/2001 | Bueley et al. |
| 6,352,164 | B1 | 3/2002 | Hyatte et al. |
| 6,510,955 | B2 | 1/2003 | Pellegrino |
| D542,632 | S | 5/2007 | Hill |
| D573,008 | S | 7/2008 | Sipe |
| D667,290 | S | 9/2012 | Chelton |
| 9,775,260 | B1 | 9/2017 | Warlick et al. |
| 9,961,995 | B2 | 5/2018 | Kam |
| D845,113 | S | 4/2019 | Salter |
| 10,610,017 | B2 * | 4/2020 | Beadle ..... A47B 57/402 |
| 10,806,257 | B1 * | 10/2020 | Liu ..... A47B 47/024 |
| D913,779 | S | 3/2021 | Murphy et al. |
| D923,464 | S | 6/2021 | Murphy et al. |
| 11,033,105 | B2 | 6/2021 | Murphy et al. |
| 11,033,106 | B2 | 6/2021 | Murphy et al. |
| 11,564,491 | B2 | 1/2023 | Murphy et al. |
| 2005/0111912 | A1 | 5/2005 | Brain et al. |
| 2006/0022105 | A1 | 2/2006 | Mackay |
| 2014/0284294 | A1 | 9/2014 | Taylor |
| 2019/0307248 | A1 | 10/2019 | Murphy et al. |
| 2020/0359794 | A1 | 11/2020 | Murphy et al. |
| 2021/0274936 | A1 | 9/2021 | Murphy et al. |

FOREIGN PATENT DOCUMENTS

| | | | |
|---|---|---|---|
| DE | 2550938 | A1 | 5/1977 |
| DE | 2713448 | A1 | 9/1978 |
| GB | 870428 | A | 6/1961 |
| KR | 200473409 | Y1 | 7/2014 |
| WO | 2018118083 | A1 | 6/2018 |

OTHER PUBLICATIONS

PCT/US2016/068524 , "International Application Serial No. PCT/US2016/068524, International Preliminary Report on Patentability dated Jul. 4, 2019", SpaceGuard Products, Inc., 11 pages.

* cited by examiner

STORAGE RACK GUARD DROP-IN BRACKET

STATEMENT OF PRIORITY

This application is a continuation of U.S. Ser. No. 17/327,095 entitled "STORAGE RACK GUARD DROP-IN BRACKET", filed May 21, 2021.

U.S. Ser. No. 17/327,095 is a continuation of U.S. Ser. No. 16/448,948 entitled "STORAGE RACK GUARD DROP-IN", filed Jun. 21, 2019, now U.S. Pat. No. 11,033,105.

U.S. Ser. No. 16/448,948 is a bypass continuation of International Application PCT/US2016/068524 entitled "STORAGE RACK GUARD DROP-IN BRACKET", filed Dec. 23, 2016, published as WO 2018/118083 on Jun. 28, 2018.

All of the above patent documents are incorporated herein by reference in their entirety for all purposes.

BACKGROUND

Field

This disclosure relates to, without limitation, storage rack guard brackets.

Description of Related Art

Storage rack guards prevent stored items from inadvertently falling from storage racks, causing damage and/or risks to personnel. Previously known storage rack guard bracket systems suffer from a number of drawbacks, including costly and time consuming installation, complexity of design, and expensive parts included as part of the design. Additionally, storage racks, especially in large warehouse environments, may be at a height or otherwise positioned in inconvenient installation environments, which increases the risk and difficulty of installing the storage rack guard.

SUMMARY

An example apparatus includes a bracket having a rack attachment member and a guard attachment member, an upper rack engagement tab in a lower rack engagement tab, where each engagement tab is coupled to the rack attachment member, and each engagement tab includes a stem portion coupled to the rack attachment member in a head portion having a greater cross-sectional area than the stem portion. The example apparatus includes a rack attachment member defining a lock pin hole positioned in proximity to one of the upper rack engagement tab and a lower rack engagement tab, where the lock pin hole is sized and positioned such that the lock pin hole provides sufficient cross-sectional area within a rack engagement distance to allow passage of a bracket lock pin through the lock pin hole within the rack engagement distance, and where the rack engagement distance is determined from a vertically lowest point of the lower rack engagement tab or the upper rack engagement tab. The example apparatus further includes a bracket lock pin having a stabilizing leg coupled to a lock pin head, the stabilizing leg having a diameter less than a diameter of the lock pin hole, and where the stabilizing leg has a geometry such that the lock pin head is urged toward the lock pin hole in the stabilizing leg is passed through the lock pin hole.

Certain further example embodiments of the apparatus are described following. An example apparatus includes the stabilizing leg having at least one of the following geometries: the stabilizing leg forming an angle with a lock pin head axis, the angle being between 30° and 105° inclusive; the stabilizing leg axis forming an angle with a lock pin head axis, the angle being between 60° and 95° inclusive; the stabilizing leg includes a weighted portion positioned thereupon; the stabilizing leg having a first straight portion and a second portion, where the second portion is one of a second straight portion and a curved portion; the stabilizing leg providing a static moment as installed, where the static moment urges the lock pin head toward the lock pin hole; the stabilizing leg being less than 1⅝" in length; the stabilizing leg being less than 3" in length; and/or the stabilizing leg being less than 3.5" in length. An example apparatus includes the rack attachment member further defining a second lock pin hole positioned in proximity to the upper rack engagement tab, where the second lock pin hole is sized and positioned such that the second lock pin hole provide sufficient cross-sectional area within a rack engagement distance to allow passage of a bracket lock pin through the second lock pin hole within the rack engagement distance, and where the rack engagement distance is determined for a vertically lowest point of the upper rack engagement tab; where the guard attachment member defines a guard attachment hole positioned at a rack guard spacing distance from the rack attachment member; where the rack guard attachment member further defines a first guard attachment hole and a second guard attachment hole, where the second guard attachment hole is positioned vertically above the first guard attachment hole; the guard attachment member further including a horizontal center axis, where each of the second guard attachment hole and first guard attachment hole are positioned an equal vertical distance from the horizontal center axis; the second guard attachment hole positioned a guard mounting distance from a top edge of the guard attachment member, and the first guard attachment hole positioned the guard mounting distance from a bottom edge of the guard attachment member; where the first guard attachment hole in the second guard attachment hole or a first pair of vertically aligned holes, and where the guard attachment member further includes at least one additional pair of vertically aligned holes. An example apparatus includes the rack engagement distance being a vertical extent of a rack column hole; the rack column hole including a teardrop storage rack hole; the guard attachment member forming a perpendicular angle with the rack attachment member; and/or where a portion of the guard attachment member defining the guard attachment hole further defines a first plane, where the rack attachment member further defines a second plane, and where the first plane is perpendicular to the second plane.

An example method includes an operation to engage a first identical bracket member to a storage rack on a first rack side and an operation to engage a second identical bracket member to the storage rack on a second rack side. The example engaging operations include positioning engagement tabs coupled to a rack attachment member of each bracket member through corresponding rack engagement features and sliding the bracket members down. The example method further includes an operation to position a first bracket lock pin through a lock pin hole in the rack attachment member of the first identical bracket member, and an operation to position a second bracket lock pin through a lock pin hole in the rack attachment member of the second identical bracket member. The positioning operations include passing a stabilizing leg of each bracket lock pin through one of the rack engagement features also having an engagement tab of the rack attachment member of the bracket member positioned therein.

Certain further example operations of a method are described following. An example method further includes an operation to position each bracket lock pin by passing the stabilizing leg of each bracket lock pin through a vertically lower one of the rack engagement features on each corresponding rack side and/or an operation to remove each bracket lock pin and the second bracket lock pin, and disengaging each of the bracket members from the storage rack. An example method further includes an operation to engage a storage rack guard to a guard attachment member. An example method further includes an operation to engage the storage rack guard with storage rack guard holes positioned on the guard attachment member of each of the identical bracket members. An example method includes engaging the storage rack guard by securing a storage rack guard member at least partially around the guard attachment member; an operation to select one from a number of horizontally displaced storage rack guard holes positioned on each guard attachment member of each of the first and second identical bracket members, where the selecting the horizontally displaced storage rack guard holes includes selecting a displacement of the storage rack guard from a rack beam of the storage rack; and/or selecting one from a number of vertically displaced storage rack guard holes positioned on each guard attachment member of each of the bracket members, where the selecting the vertically displaced storage rack guard holes includes selecting a vertical position of the storage rack guard.

An example system includes a storage rack having a number of vertical columns, each vertical column having a number of rack engagement features, each of the rack engagement features defining a hole in the vertical column; a first and second identical bracket, each bracket including a rack attachment member and a guard attachment member, an upper rack engagement tab and a lower rack engagement tab, where each engagement tab is coupled to the rack attachment member, and each engagement tab includes a stem portion coupled to the rack attachment member and a head portion having a greater cross-sectional area than the stem portion, where the rack attachment member defines a lock pin hole positioned in proximity to one of the upper rack engagement tab in the lower rack engagement tab, and the lock pin is sized and positioned such that the lock pin hole provides sufficient cross-sectional area within a rack engagement distance to allow passage of a bracket lock pin through the lock pin hole within the rack engagement distance, and where the rack engagement distance is determined from a vertically lowest point of the one of the lower rack engagement tab and the upper rack engagement tab. The example system further includes a first and second bracket lock pin, each having a stabilizing leg coupled to a lock pin head, the stabilizing leg having a diameter less than a diameter of the lock pin hole, the lock pin head having a diameter greater than a diameter of the lock pin hole, and where the stabilizing leg has a geometry such that the lock pin head is urged toward the lock pin hole when the stabilizing leg is passed through the lock pin hole.

Certain further embodiments of an example system are described following. An example system includes the vertical columns of the storage rack having an enclosed back, and/or a storage rack guard engaged to a guard attachment hole of each guard attachment member of each of the first and second identical bracket members, where the guard attachment hole of each guard attachment member is positioned at the same vertical height, and where the storage rack guard includes a wire mesh, a steel mesh, an expanded metal mesh, a nylon mesh, plastic, and/or netting.

An example kit includes a number of identical brackets, each bracket including a rack attachment member and a guard attachment member, an upper rack engagement tab and a lower rack engagement tab, where each engagement tab is coupled to the rack attachment member, and each engagement tab includes a stem portion coupled to the rack attachment member and a head portion having a greater cross-sectional area than the stem portion, where the rack attachment member defines a lock pin hole above the lower rack engagement tab, and where the lock pin hole provides sufficient cross-sectional area within a rack engagement distance to allow passage of a bracket lock pin through the lock pin hole within the rack engagement distance, and where the rack engagement distance is determined from a vertically lowest point of the one of the lower rack engagement tab and the upper rack engagement tab. The example kit further includes a number of bracket lock pins having a stabilizing leg coupled to a lock pin head, the stabilizing leg having a diameter less than a diameter of the lock pin hole, the lock pin head having a diameter greater than a diameter of the lock pin hole, and where the stabilizing leg has a geometry such that the lock pin head is urged toward the lock pin hole when the stabilizing leg is passed through the lock pin hole.

Certain further embodiments of an example kit are described following. An example kit includes each stabilizing leg having at least one of the following geometries: the stabilizing leg axis forming an angle with a lock pin head axis, the angle being between 30° and 105° inclusive; the stabilizing leg axis forming an angle with a lock pin head axis, the angle being between 60° and 95° inclusive; the stabilizing leg including a weighted portion positioned thereupon; the stabilizing leg including a first straight portion and a second portion, where the second portion is one of a second straight portion and a curved portion; the stabilizing leg providing a static moment as installed, the static moment urging the lock pin head toward the lock pin hole; the stabilizing leg being less than 1⅝" in length; the stabilizing leg being less than 3" in length; and/or the stabilizing leg being less than 3.5" in length. An example kit further includes each rack attachment member further defining a second lock pin hole positioned in proximity to the upper rack engagement tab, where the second lock pin hole is sized and positioned such that the second lock pin hole provide sufficient cross-sectional area within a rack engagement distance to allow passage of a bracket lock pin through the second lock pin hole within the rack engagement distance, and where the rack engagement distance is determined from a vertically highest point of the upper rack engagement tab, each an example kit further includes each guard attachment member further defining a second guard attachment hole positioned vertically above the guard attachment hole, where each guard attachment member includes a horizontal center axis, and where each of the second guard attachment hole and guard attachment hole are positioned an equal vertical distance from the horizontal center axis. An example kit further includes each guard attachment member further defining a second guard attachment hole positioned vertically above the guard attachment hole, where the second guard attachment hole is positioned a guard mounting distance from a top edge of each guard attachment member, and where the guard attachment hole is positioned the guard mounting distance from a bottom edge of each guard attachment member.

These and other systems, methods, objects, features, and advantages of the present invention will be apparent to those skilled in the art from the following detailed description of certain embodiments and the drawings. All documents mentioned herein are hereby incorporated in their entirety by reference.

BRIEF DESCRIPTION OF THE FIGURES

The invention and the following detailed description of certain embodiments thereof may be understood by reference to the following figures.

Figure 1:
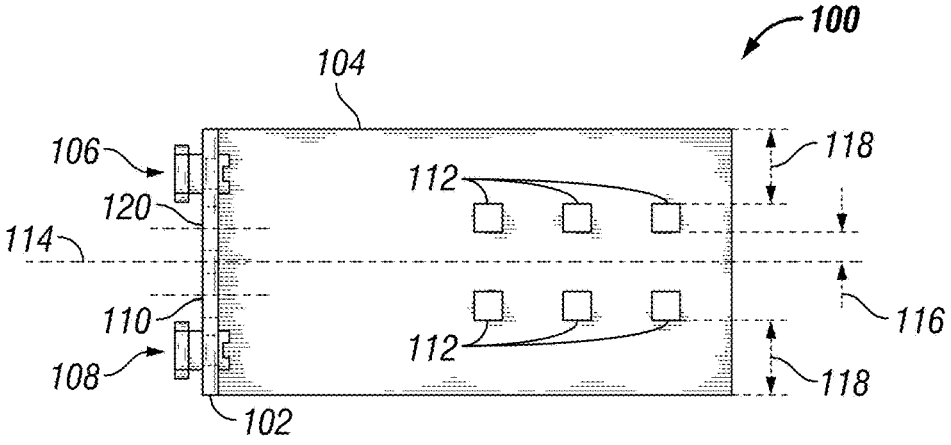
FIG. 1 is a schematic diagram of a bracket.

While the invention has been described with specificity in connection with certain embodiments, other embodiments would be understood to be contemplated herein by one of ordinary skill in the art having the benefit of the present disclosure, and are encompassed herein.

DETAILED DESCRIPTION

For the purposes of promoting an understanding of the principles of the invention, reference will now be made to specific embodiments illustrated in the drawings and specific language will be used to describe the same. It will nevertheless be understood that no limitation of the scope of the invention is thereby intended, and any alterations and further modifications in the illustrated embodiments, and any further applications of the principles of the invention as illustrated therein as would normally occur to one skilled in the art to which the invention relates are contemplated herein.

The disclosure is directed to a drop-in bracket that can be installed readily and without the use of tools. Certain applications for the drop-in bracket are described as a storage rack guard, although the disclosure is not limited to such embodiments. Any device may be mounted on the drop-in bracket, including at least a rack guard, a screen guard, a pallet protector, a rack back backing, a protective backing, or other devices. Additionally or alternatively, a guard, protector, or backing device may include mesh containment walls such as, but not limited to a wire mesh, a steel mesh, an expanded metal mesh, a nylon mesh, plastic, and/or netting. In certain embodiments, the storage rack guard may be positioned on the back of the rack or on the front of the rack. Example and non-limiting storage rack applications include a structural storage rack and/or a selective storage rack.

Referencing FIG. 1, an example bracket 100 includes a rack attachment member 102 and a guard attachment member 104. The bracket 100 further includes an upper rack engagement tab 106 and a lower rack engagement tab 108. Example engagement tabs 106, 108 include a rivet, bolt, or other feature coupled to the rack attachment member 102 and having sufficient structural strength to support the bracket 100 when engaged to a rack, and an additional loading on the bracket when a storage rack guard or other desired device is coupled to the bracket. The description of the engagement tabs 106, 108 as "upper" and "lower" are for convenience of description only. In certain embodiments, the bracket 100 may be positioned with the upper engagement tab 106 vertically above the lower engagement tab 108, and in other embodiments the bracket 100 may be positioned with the upper engagement tab 106 vertically below the lower engagement tab 108. In certain embodiments, for example during times when the bracket 100 is not engaged with a rack, the vertical positioning of the engagement tabs 106, 108 may be irrelevant. Insert further embodiments an example bracket 100 may include only a single engagement tab, or three or more engagement tabs, as will be understood to one of skill in the art, and may depend upon space considerations for a particular application, and/or the weight to be applied to the bracket 100.

Figure 2:
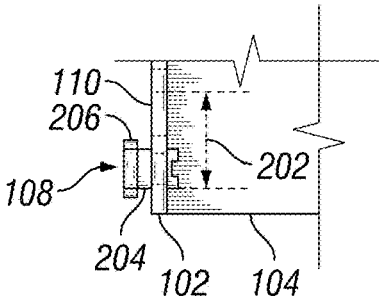
FIG. 2 is a schematic diagram of a portion of a bracket and a rack engagement distance.

FIG. 2 depicts an example close-up of an engagement tab 108 coupled to the rack attachment member 102. As shown in FIG. 2, each engagement tab 106, 108 includes a stem portion 204 coupled to the rack attachment member 102 and a head portion 206 having a greater cross-sectional area than the stem portion 204. The head portion 206 is sized to fit through a rack engagement feature, and to have at least a lower lip that supports the bracket 100 when engaged with a rack engagement feature.

Figure 5:
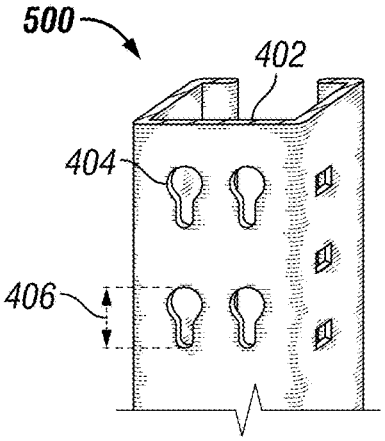
FIG. 5 (Prior Art)
FIG. 5 is a depiction of a portion of a vertical column.

The example rack attachment member 102 further defines a lock pin hole 110 above the lower rack engagement tab 108. The lock pin hole 110 is sized and positioned such that the lock pin hole provides sufficient cross-sectional area within a rack engagement distance to allow passage of a bracket lock pin through the lock pin hole within the rack engagement distance, where the rack engagement distance is determined from a vertically lowest point of the lower rack engagement tab 108. An example rack engagement distance 406 is depicted in FIG. 5, for example the height of a hole 404 that is a rack engagement feature. The example rack engagement feature 404 is a teardrop rack hole, although other shapes are possible. The teardrop shape allows for the rack engagement tab stem 204 to rest in the lower diameter portion of the hole for improved bracket 100 stability, but the lower lip of the rack engagement tab head portion 206 can secure the bracket 100 in a variety of hole 404 shapes. The description of the lock pin hole 110 as "above" the lower rack engagement tab stem 204 is for convenience of description. The lock pin hole 110 is positioned such that a hole is provided in the rack attachment member 102 above either (or both) of the rack engagement features 106, 108 when the bracket 100 is engaged with a rack, and such that the hole provides access within the geometry of the rack engagement feature 404. The lock pin hole 110 may be constrained to have a vertical limit lower than the top of the rack engagement feature 404 when the bracket 100 is engaged—for example when the vertical distance 202 is less than the rack engagement distance 406. One of skill in the art will recognize that, even if the lock pin hole 110 extends higher than the rack engagement feature 404 when the bracket 100 is engaged, access is provided within the geometry of the rack engagement feature 404.

In the example embodiment of FIG. 1, the bracket 100 includes a lock pin hole 110 above the lower engagement tab 108 and a second lock pin hole 120 below the upper engagement tab 106, such that when the bracket 100 is engaged, a hole provides access within the geometry of the rack engagement feature 404 above the vertically lower one of the lower engagement tab 108 and the upper engagement tab 106, whether the bracket 100 is applied on a right side or a left side of a storage rack (e.g. the bracket 100 is reversible without having to consider which side to place it on). Similarly (not shown), a bracket 100 could be configured with holes alternatively or additionally placed above the upper engagement tab 106 and/or below the lower engagement tab 108, such that when the bracket 100 is engaged, a hole provides access within the geometry of the rack engagement feature 404 above a vertically higher one of the lower engagement tab 108 and the upper engagement tab 106. One of skill in the art, having the benefit of the disclosure herein and information normally available to one of skill in the art contemplating a particular application for a bracket 100, can readily provide holes 110, 120 that allow for access within the geometry of a rack engagement feature 404 above either the vertically higher or lower one of the engagement tabs 106, 108, or both, and allow for reversibility of the bracket 100 if desired. Certain non-limiting considerations in determining which hole positions to provide include cost of manufacture of the resulting bracket design, the types and arrangements of rack engagement features 404 for the contemplated rack, the desire for reversibility and/or convenience of bracket 100 utilization, the arrangement of racks and/or rack protectors to be utilized, and whether use of a vertically upper or vertically lower engagement tab 106, 108 for access to the rack engagement feature 404 is desired for the particular application.

The example bracket 100 includes the guard attachment member 104 defining a guard attachment hole 112 (e.g. any one of the example holes 112) positioned at a rack guard spacing distance (not shown) from the rack attachment member 102. The rack guard spacing distance is the horizontal distance along the guard attachment member 104 from the rack attachment member 102 at which the hole 112 is positioned, and wherein a storage rack guard, screen guard, or other feature will be attached to the bracket 100. The rack guard spacing distance depends upon the circumstances of the particular installation, and may be any value within the structural limitations of the bracket 100 (e.g. depending upon the weight of the bracket 100 and feature attached to the bracket). Example and non-limiting rack guard spacing values include 3", 4", 5", 6", 8", 10", 12", values between 1" and 12" inclusive, and values between 1" and 18" inclusive. Although the described rack guard spacing values are not limited to a particular unit of measure, certain systems, manufacturers, and/or other users of a bracket 100 may determine rack guard spacing values in metric terms. Rack guard spacing values, without limitation, of at least 50 mm, 100 mm, 150 mm, 200 mm, 250 mm, 300 mm, and between 50 mm and 300 mm inclusive. One of skill in the art, having the benefit of the disclosures herein and information ordinarily available to one of skill in the art contemplating a particular application for a bracket 100, can readily select rack guard spacing distance(s) for a particular bracket 100. Certain non-limiting considerations for selecting rack guard spacing distance(s) include the desired standoff (e.g. distance from a rack) of the feature mounted to the bracket, regulatory and/or policy requirements for the standoff of the mounted feature (e.g. safety policies or regulations, compatibility to standards, etc.), the desired or required distance the bracket 100 should extend away from a rack, backwards compatibility of a bracket 100 with prior used brackets, the purpose and/or type of protection contemplated for the rack guard, space available for the rack guard, the size of a rack and/or the size of objects to be placed on the rack, and/or customer defined expectations for a bracket 100. A nonlimiting example includes a 42 inch rack having a 48 inch pallet there on, and a 4 inch rack guard spacing. Another nonlimiting example includes a rack guard position between a rack and a facility wall, wherein the rack guard spacing is selected prevent objects falling off of the rack from hitting the facility wall. Yet another nonlimiting example includes objects that are eccentric and/or having a high center of gravity, in a rack guard spacing selected to be close to the rack, for example to prevent objects from becoming unstable.

While the example guard attachment member 104 is depicted having a guard attachment hole 112, in certain embodiments the guard attachment member 104 may not have a guard attachment hole 112, and may attach to a rack guard through any alternative means understood in the art. For example, and without limitation, a guard attachment member 104 may have a circular or other cross-sectional area, in a rack guard may attach to the guard attachment member 104 by resting on, clipping on, and/or otherwise attaching to the guard attachment member 104 without a guard attachment hole 112 present. The example guard attachment hole 112 is depicted as a square hole, however the guard attachment hole 112 may be of any size or shape to accommodate attachment to a selected rack guard.

Figure 3:
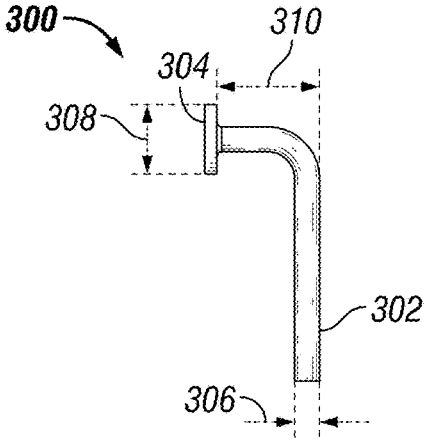
FIG. 3 is a schematic diagram of a bracket lock pin.

An example apparatus includes the bracket 100 and a bracket lock pin 300 (reference FIG. 3). An example bracket lock pin 300 includes a stabilizing leg 302 coupled to a lock pin head 304. The example bracket lock pin 300 includes the stabilizing leg 302 spaced a distance 310 to allow the stabilizing leg 302 to pass over the bracket rack attachment member 102, the rack vertical column 402 wall (reference FIG. 4), and the associated engagement tab 106, 108 when positioned to lock the bracket 100 in place. In certain embodiments, the bracket lock pin 300 may not include a spacing distance 310, but may include a stabilizing leg 302 shape or other feature to provide spacing to engage bracket 100 and rack engagement feature 406 and lock the bracket in place. The example stabilizing leg 302 includes a diameter 306 less than a diameter of the lock pin hole 110, and the lock pin head 304 includes a diameter 308 greater than a diameter of the lock pin hole 110. The description of the bracket lock pin 300 having a "diameter" is for convenience of description with regard to the example bracket lock pin 300. In certain embodiments, the bracket lock pin 300 has a cross-sectional shape of the stabilizing leg 302 such that the stabilizing leg 302 can be passed through the lock pin hole 110, and the bracket lock pin 300 has a cross-sectional shape of the lock pin head 304 such that the lock pin head 304 does not pass through the lock pin hole 110. Any shape of bracket lock pin 300 features and lock pin hole 110 (and/or second lock pin hole 120) is contemplated herein. The description including a "diameter" includes, in certain embodiments and without limitation, a circular shape, a circular shape with allowances for manufacturing artifacts, an elliptical shape, a triangular shape, a quadrilateral shape, any polygonal shape (regular or otherwise), and combinations of these. One of skill in the art will recognize that each of these shapes provide certain advantages or drawbacks (e.g. ease of manufacture, ease of handling, structural integrity), and each potential shape and combination thereof is specifically contemplated individually.

The example stabilizing leg 302 has a geometry such that the lock pin head 304 is urged toward the lock pin hole 110 when the stabilizing leg 302 is passed through the lock pin hole 110. As described in relation to FIG. 1 preceding, any of the holes 110, 120 depicted on the rack attachment member 102, and/or other holes provided on the rack attachment member 102 but not depicted (e.g. above the upper engagement tab 106 and/or below the lower engagement tab 108) may similarly be configured to allow the stabilizing leg 302 therethrough and not allow the lock pin head 304 therethrough. Additionally or alternatively, any holes (e.g. 110, 120) provided on the rack attachment member 102 may be the same shape or distinct shapes, while still providing the described engagement with the bracket lock pin 300.

Figure 4:
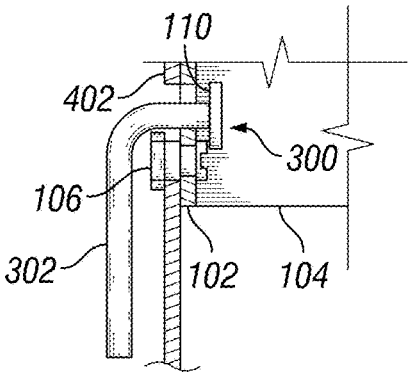
FIG. 4 is a schematic diagram of a bracket engaged with a vertical column.

Referencing FIG. 4, an example bracket lock pin 300 is depicted engaged with a bracket and vertical column 402 of a rack at the rack engagement feature 404. The bracket guard attachment member 104 extends away from the rack, with the lower engagement feature 108 engaged with the rack, and the bracket rack attachment member 102 abutting the rack. The bracket lock pin 300 is positioned with the stabilizing leg 302 passed through the lock pin hole 110, with the lock pin head 304 urged toward the lock pin hole 110 by the static moment of the stabilizing leg 302. The bracket lock pin 300 positioned through the lock pin hole 110 and the rack engagement feature 404 prevents lifting of the bracket while the bracket lock pin 300 remains engaged, for example by interference between the rack engagement feature 404 upper side and the lower engagement feature 108 sufficient to prevent the lower engagement feature 108 lifting sufficiently that the lower lip of the engagement feature head 206 disengages from the rack engagement feature 404 lower side. Without limitation to other features and advantages, the example bracket lock pin 300 and bracket 100 provides an apparatus that is readily installed and disengaged without complex tools or operating fine mechanical parts or springs, and without small parts that require manipulation or that can be dropped and/or lost during installation. Additionally, the example bracket 100, in certain embodiments, is provided such that the bracket 100 can be installed without consideration to a left-side or right-side of the rack.

Figure 6:
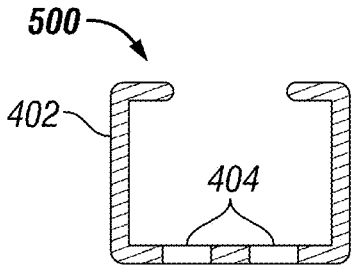
FIG. 6 (Prior Art)
FIG. 6 is a depiction of a top view of a vertical column.
Figure 7:
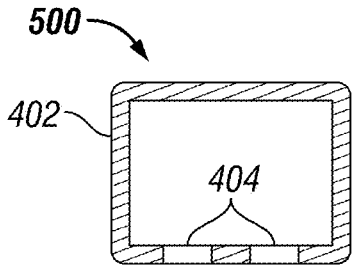
FIG. 7 (Prior Art)
FIG. 7 is a depiction of a top view of a vertical column.

Referencing FIGS. 5, 6, and 7, example racks 500 are shown that, in certain embodiments, are compatible with the example brackets 100 and bracket lock pins 300 described herein. The racks 500 are known in the art, but the description herein provides additional clarity to certain features of the present description. Referencing FIG. 5, a rack 500 includes a vertical column 402 having rack engagement features thereon. The rack 500 includes square holes down the sides (not numbered) that are typically used to mount racks between columns 402 at a selectable height. The vertical column 402 includes teardrop rack engagement features 404 having a rack engagement distance 406 (e.g. the height of one of the teardrops). The rack engagement features 404 are typically spaced in even vertical increments, and may be paired horizontally or in other configurations. The brackets 100 and bracket lock pins 300 described herein are compatible with teardrop rack engagement features 404, or rack engagement features 404 having other shapes. Referencing FIG. 6, a top view of a vertical column 402 of a rack 500 is depicted. The rack engagement features 404 are on a "front" side of the vertical column (which may be facing in any direction on the rack 500 as installed—for example the front face of the rack, the rear face of the rack, or a side of the rack). It can be seen that the vertical column 402 depicted in FIG. 6 has an open back. Referencing FIG. 7, a top view of a vertical column 402 of a rack 500 is depicted. In contrast with the rack 500 depicted in FIG. 6, the rack 500 has a closed back.

Figure 8:
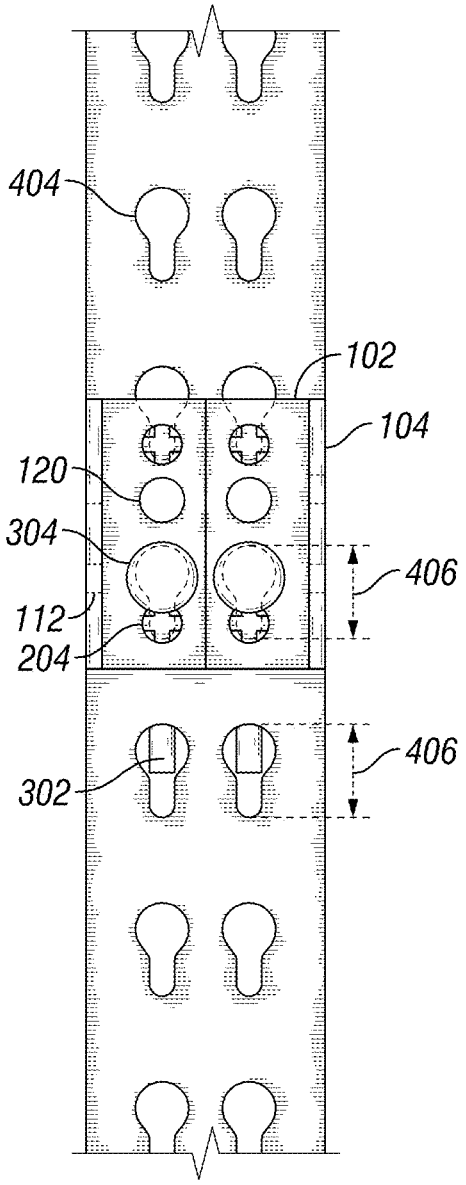
FIG. 8 is a schematic diagram of a pair of brackets engaged with a vertical column.
Figure 9:
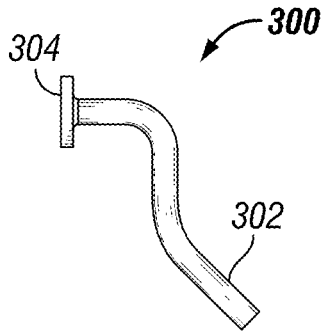
FIG. 9 is a schematic diagram of an example bracket lock pin.
Figure 10:
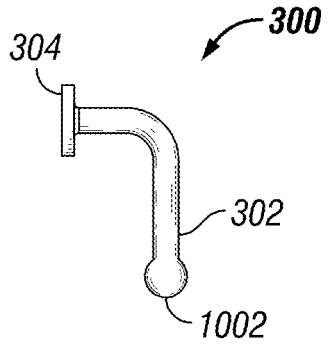
FIG. 10 is a schematic diagram of another example bracket lock pin.
Figure 11:
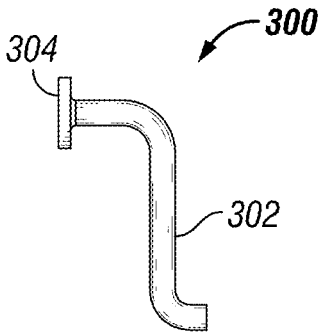
FIG. 11 is a schematic diagram of another example bracket lock pin.
Figure 12:
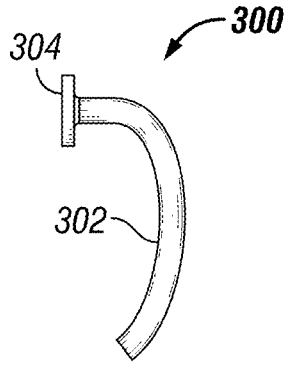
FIG. 12 is a schematic diagram of another example bracket lock pin.
Figure 13:
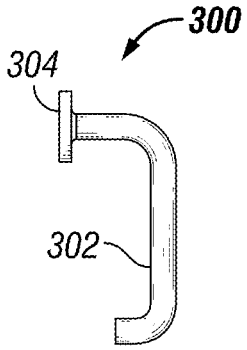
FIG. 13 is a schematic diagram of another example bracket lock pin.
Figure 14:
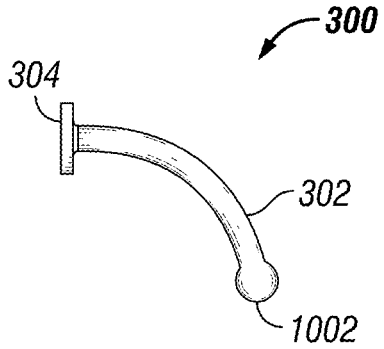
FIG. 14 is a schematic diagram of another example bracket lock pin.

Referencing FIG. 8, a pair of brackets 100 are depicted engaged side-by-side on a single vertical column. In certain embodiments, the rack attachment member 102 includes a length selected to allow the installation of two brackets 100 side-by-side as shown. Additionally or alternatively, a single bracket may be configured with two sets of rack engagement features, two sets of lock pin holes 110 (and/or guard attachment holes 120, and/or additional holes as described in the description referencing FIG. 1 preceding), and/or two guard attachment members 104 (e.g. resulting in a "U-shaped" bracket). In certain embodiments, the rack attachment member 102 length may be selected without reference to preserving the ability to install two brackets 100 side-by-side as depicted in FIG. 8, and/or may be selected to preserve the ability to install two brackets 100 side-by-side on certain vertical column 402 sizes and rack engagement feature 404 spacings, but not in other sizes or spacings. In the embodiment depicted in FIG. 8, the bracket drop pins 300 are installed with the lock pin head 304 visible and the bracket guard attachment members 104 extended toward the viewer of the figure.

Referencing FIGS. 9 through 14, certain example embodiments of a bracket lock pin 300 are depicted. The vertical columns 402 have a depth extending away from the front face having the rack engagement features 404, and the vertical columns 402 may be open-backed (e.g. FIG. 6) or closed-backed (e.g. FIG. 7). Accordingly, depending upon the intended application, the geometry of the vertical column 402 may constrain certain embodiments of the bracket lock pin 300. An example bracket lock pin 300 such as in FIG. 3 includes a stabilizing leg 302 at an angle with the lock pin head 304 axis—for example in FIG. 3 the angle is depicted as approximately 90° (perpendicular). In certain embodiments, the angle between the stabilizing leg 302 and the lock pin head 304 axis may be between 30° and 105° inclusive, and/or between 60° and 95° inclusive. One of skill in the art, having the benefit of the disclosures herein and information ordinarily available to one of skill in the art contemplating a particular application for a bracket lock pin 300, can readily determine appropriate angles between the stabilizing leg 302 and lock pin head 304 axis. Certain non-limiting considerations for determining such an angle include a length of the stabilizing leg 302, likely loads on the system (rack, bracket and/or installed feature on the bracket) such as impact loads, vibration, and weight of aspects of the system, the geometry of the vertical columns 402 (e.g. size, open or closed back, etc.), the desired margin against a disturbance causing a disengagement of the bracket lock pin 300, and/or the desired ease of engaging and disengaging the bracket lock pin 300. Example and non-limiting lengths for the bracket lock pin 300 includes the stabilizing leg 302 being less than 1⅝" in length, the stabilizing leg being less than 3" in length, and/or the stabilizing leg being less than 3.5" in length.

Certain additional or alternative geometries may be selected for the stabilizing leg 302. An example stabilizing leg includes the stabilizing leg having a first straight portion and a second portion that may be straight or curved (see, e.g. FIG. 9); another example stabilizing leg includes a weighted portion 1002 on the stabilizing leg 302 (the weighted portion may be created by any method understood in the art, including at least inclusion of a material having increased density, addition of material onto the formed stabilizing leg 302, and/or deformation of an end of the stabilizing leg 302), where the weighted portion 1002 is provided on a straight (see, e.g. FIG. 10) or a curved (see, e.g. FIG. 14) portion of the stabilizing leg. Referencing FIGS. 11, 12, and 13, example stabilizing legs 302 includes portions that change the static moment of the stabilizing 302 leg to provide a desired urging force on the lock pin head 304 when installed, alter or enhance ease of installation and/or removal, and/or are shaped to accommodate aspects of the system that may be present when the bracket 100 is installed on a rack 500. The described shapes referenced in FIGS. 9-14 are non-limiting examples. One of skill in the art, having the benefit of the disclosures herein and information ordinarily available to one of skill in the art contemplating a particular system, can readily determine a shape for the bracket lock pin 300 appropriate to the system. Non-limiting considerations for determining such a shape include the desired urging force on the lock pin head 304, likely loads on the system (rack, bracket and/or installed feature on the bracket) such as impact loads, vibration, and weight of aspects of the system, the geometry of the vertical columns 402 (e.g. size, open or closed back, etc.), the desired margin against a disturbance causing a disengagement of the bracket lock pin 300, and/or the desired ease of engaging and disengaging the bracket lock pin 300, the ease and/or cost of manufacture of the bracket lock pin 300, the structural integrity of the bracket lock pin 300 in view of expected loads and/or load requirements (e.g. regulatory, policy, or compliance requirements) of the bracket lock pin 300, and/or the geometry of the environment of the bracket lock pin 300 as installed (e.g. thickness of bracket rack attachment member 102, depth of rack, presence of rack bolts or fixing features, closed or open nature of the rack, thickness of the rack vertical column 402 material, and/or the size and positioning of the associated engagement tab 106, 108).

Again referencing FIG. 1, a bracket 100 includes the rack attachment member 102 further defining a second lock pin hole 120 positioned below the upper rack engagement tab 106, where the second lock pin hole 120 is sized and positioned such that the second lock pin hole 120 provides sufficient cross-sectional area within a rack engagement distance to allow passage of a bracket lock pin 300 through the second lock pin hole 120 within the rack engagement distance 406, where the rack engagement distance 406 is determined from a vertically highest point of the upper rack engagement tab 106. It will be understood that where the second lock pin hole 120 is positioned below the upper rack engagement tab 106, the rack engagement distance 406 is determined from a vertically highest point of the upper rack engagement tab 106, and where the second lock pin hole 120 is positioned above the upper rack engagement tab 106, the rack engagement distance 406 is determined from a vertically lowest point of the upper rack engagement tab 106. As described preceding, the second lock pin hole 120 provides for, without limitation, convenient reversibility of the bracket 100. An example bracket 100 further includes the guard attachment member 104 defining a second guard attachment hole 112 positioned vertically above the guard attachment hole 112 (e.g. any one of the vertical pairs of holes 112 depicted on the bracket 100). In a further embodiment, an example guard attachment member 104 further includes a horizontal center axis 114, where each of the second guard attachment hole 112 and guard attachment hole 112 are positioned an equal vertical distance 116 from the horizontal center axis 114. An example guard attachment member 104 includes the second guard attachment hole 112 positioned a guard mounting distance 118 from a top edge of the guard attachment member 104, and the guard attachment hole 112 positioned the guard mounting distance 118 from a bottom edge of the guard attachment member 104. It can be recognized that the use of more than one vertically aligned hole allows for controllable vertical placement of a rack guard or other feature mounted to the bracket 100, including when the bracket is reversed (e.g. from the left side of a rack to the right side of a rack). The utilization of consistent distances 116 and/or 118 further allows for consistent vertical placement of a rack guard or other feature mounted to the bracket when the bracket is reversed.

In certain embodiments, the guard attachment hole 112 and the second guard attachment hole 112 including a first pair of vertically aligned holes (e.g. any one of the vertically aligned pairs in FIG. 1), and the guard attachment member 104 further including at least one additional pair of vertically aligned holes (e.g. any other one of the vertically aligned pairs in FIG. 1). In certain embodiments multiple horizontally spaced holes 112 may be provided without having paired vertical holes thereto. The use of horizontal spaced holes 112 allows for the selectability of the feature (e.g. a rack guard) offset from the rack when the feature is mounted to the bracket 100. The use of vertical spaced holes 112 allows for selectability and/or consistency of vertical positioning of the feature mounted to the bracket 100, including, if desired for a particular embodiment, consistent vertical positioning regardless of the bracket 100 being positioned on the right or left side of a rack. Any arrangement of holes 112 is contemplated herein, including vertically paired holes at certain horizontal locations with only single holes at other horizontal locations, and/or the use of multiple holes (e.g. three or more vertically aligned holes at one or more horizontal positions). An example embodiment includes a single hole 112 on the bracket guard attachment member 104. A further example embodiment includes the single hole 112 positioned along the horizontal center axis 114.

Figure 16:
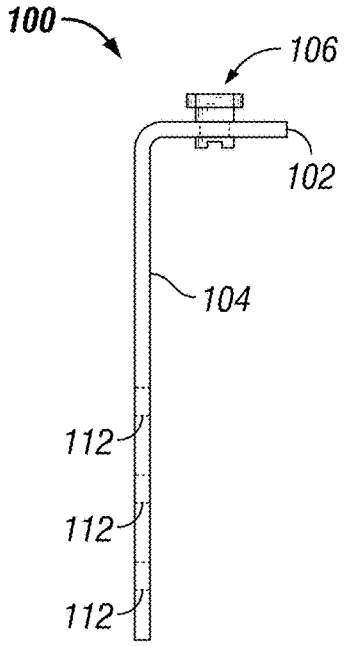
FIG. 16 is a schematic diagram of a top view of a first example bracket.
Figure 17:
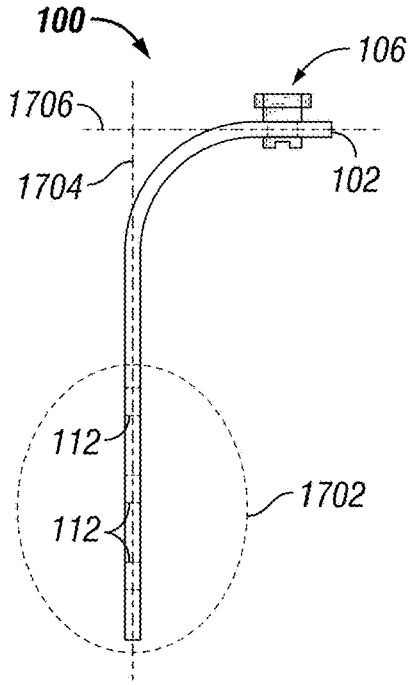
FIG. 17 is a schematic diagram of a top view of a second example bracket.

Referencing FIG. 16, an example bracket 100 guard attachment member 104 forms a perpendicular angle with the rack attachment member 102. Referencing FIG. 17, an example bracket 100 includes a portion 1702 of the guard attachment member 104, the portion 1704 including the guard attachment hole(s) 112, where the portion 1702 defines a first plane 1704, where the rack attachment member 102 defines a second plane 1706, and wherein the first plane 1704 is perpendicular to the second plane 1706. The progression of the bracket 100 from the rack attachment member 102 to the portion 1702 is depicted as a curved portion in the FIG. 17, but may be any shape. The embodiments depicted in FIGS. 16 and 17 provide for a mounting of a feature (e.g. a storage rack guard) to the guard attachment hole 112 that results in the feature being parallel to the rack (e.g. parallel to the rack attachment member 102). However, the guard attachment hole 112 need not be positioned on a portion of the bracket that is perpendicular to the rack attachment member 102—for example to accommodate a particular size or shape of feature mounted to the bracket 100, to accommodate a curved feature, and/or to have the bracket 100 as installed with the mounted feature apply some force to the feature as installed (e.g. deforming the bracket guard attachment member 104 to perpendicular or another shape as a part of the installation).

Figure 15:
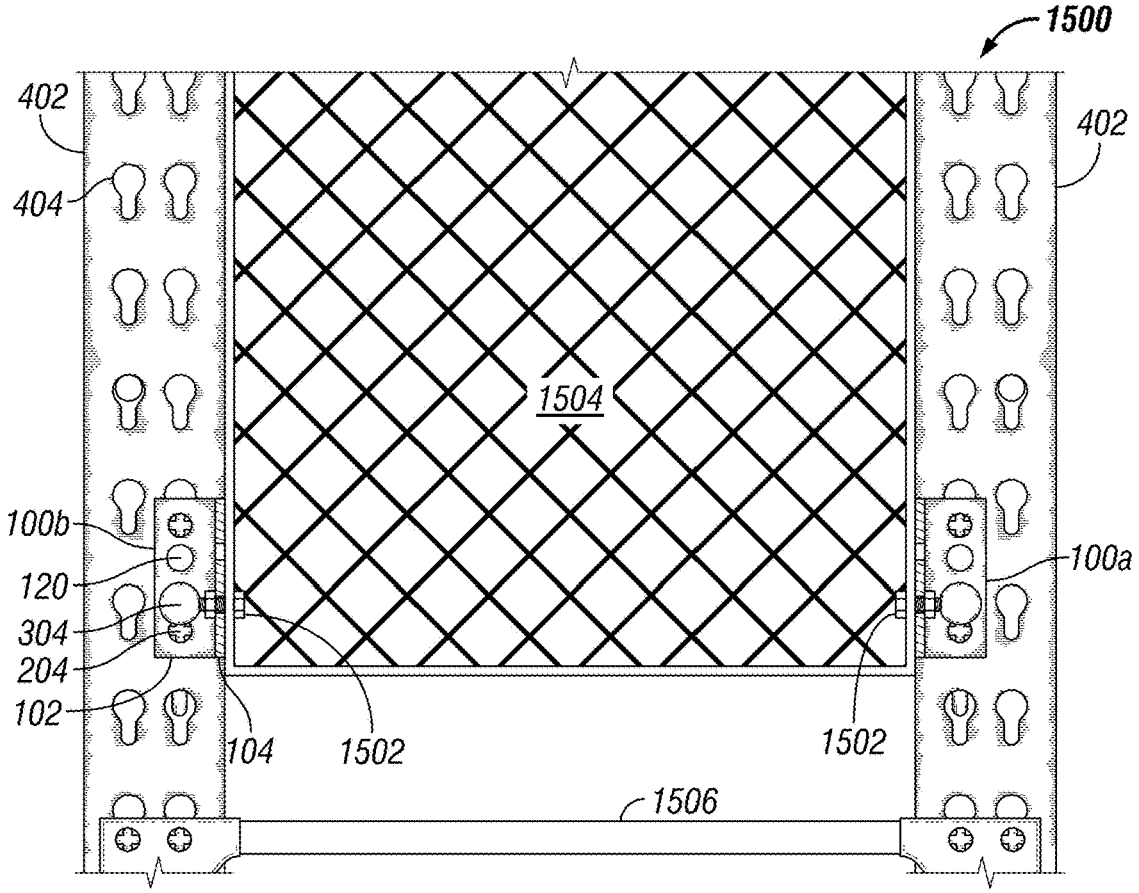
FIG. 15 is a schematic diagram of a pair of brackets engaged with vertical columns, with a rack guard mounted thereupon.

Referencing FIG. 15, an example system 1500 is depicted. The system 1500 includes a rack (e.g. a structural storage rack, a selective storage rack, and/or any other type of storage rack) having a number of vertical columns 402, each vertical column having a number of rack engagement features 404, and where each of the rack engagement features 404 defines a hole in the vertical column 402. Each hole has a height that includes a rack engagement distance 406. The system 1500 includes a first bracket 100*a* and a second bracket 100*b* that are identical brackets. Identical brackets, in the sense utilized herein, should be understood broadly, and includes: the first and second brackets manufactured to the same specifications (and/or including allowances for manufacturing tolerances and/or errors that nevertheless result in a usable bracket); the first and second brackets manufactured to the same geometry (e.g. materials, manufacturing processes, etc. may vary); the first and second brackets manufactured to the same functionality for the purposes of the system 1500 (e.g. the same part number or an accepted equivalent part number, any feature differences not relevant to the installation—such as holes 112 on the guard attachment member 104 being present on both at the intended installation location even if the overall hole configurations differ); and the first 100*a* and second 100*b* brackets being reversible with each other without a material change to the installation (e.g. the installation would still meet regulatory and/or policy compliance, and/or the geometry of the installation would not vary beyond acceptable limits). Each of these examples of "identical" for the brackets 100*a*, 100*b* may have relevance to a particular installation, and each individually may not be acceptable to other particular installations, while other considerations may be utilized to determine whether brackets are identical. One of skill in the art, having the benefit of the disclosures herein and knowledge ordinarily available, can readily determine the criteria defining whether brackets are identical for a given installation. Certain considerations for defining whether brackets are identical, alternatively or additionally to those provided preceding, include the interchangability of the brackets for a given installation, appropriate rules, regulations, and policies for the installation, the mounting geometry and tolerances of the installation, and/or administrative requirements for the installation including part tracking and/or part number system information.

Each of the first 100*a* and second 100*b* identical brackets may be configured according to any of the descriptions herein, with the limitation that the first 100*a* and second 100*b* identical brackets must be reversible for the purposes of the mounting of the rack guard 1504 to the brackets 100*a*, 100*b*. For example, each bracket 100*a*, 100*b* must have a hole accessing the geometry of one of the rack engagement features 404 for at least one of the top and bottom engagement features of the respective bracket regardless of whether the bracket 100*a*, 100*b* is mounted on the left or right side of the rack. The example system 1500 further includes bracket lock pins 300 engaging the rack attachment member 102 of each bracket through the lock pin hole 110 (not visible in FIG. 15, as it is obscured by the lock pin head 304), or vertically lower hole, and/or vertically higher hole, on each bracket and engaging the vertical column 402 through an engagement feature 404 shared with and above one of the engagement tabs 106, 108 of the rack attachment member 102. The lock pin hole 110 may be utilized to reference either of the holes in the rack attachment member 102, where more than one hole is present, and/or may be utilized to reference the hole through which the geometry of the rack engagement feature 404 is present and through which the bracket lock pin 300 is engaged. The bracket lock pin 300, lock pin head 304, and stabilizing leg 302 may be configured according to any bracket lock pin 300 described herein.

Certain further embodiments of an example system 1500 are described following. An example system 1500 includes the vertical columns 402 of the storage rack having an enclosed back (e.g. as depicted in FIG. 7), and/or a storage rack guard 1504 engaged to the guard attachment hole 112 of each guard attachment member 104 of each of the first and second identical bracket members 100*a*, 100*b*. The "storage rack guard" 1504 may be any device or feature desired to be attached to the brackets 100*a*, 100*b*, including a wire mesh, net, steel mesh, an expanded metal mesh, a nylon mesh, plastic, a netting, or other device to be positioned in proximity to a rack beam 1506. In certain embodiments, the guard attachment hole 112 of each guard attachment member 104 is positioned at the same vertical height, regardless of which bracket 100*a*, 100*b* is installed on the right or left. The engagement of the storage rack guard 1504 to the brackets 100*a*, 100*b* includes utilization of a bolt 1502, or any other engagement device desired (e.g. pegs, engagement tabs, rivets, clipping, snapping, or otherwise directly attaching to the body of the guard attachment member 104, or any other desired connection scheme).

An example kit (not pictured) includes a number of identical brackets 100. The identical brackets 100 may be configured according to any bracket 100 described herein, and the description of "identical bracket" with respect to the system 1500 is incorporated herein. The kit further includes a number of bracket lock pins 300, which may be configured according to any description of a bracket lock pin 300 described herein. One of skill in the art, having the benefit of the disclosure herein, will recognize that such a kit provides at least the benefits of a convenient set of parts for rapidly mounting and/or disengaging brackets from a rack, where the operator does not need to track which bracket is to be mounted on which side, and/or which can be readily installed or removed without the use of special tools and in a few conveniently performed operations.

The schematic operational descriptions which follow provide illustrative embodiments of performing procedures for installing and removing brackets and/or storage rack guards. Operations illustrated are understood to be exemplary only, and operations may be combined or divided, and added or removed, as well as re-ordered in whole or part, unless stated explicitly to the contrary herein.

Figure 18:
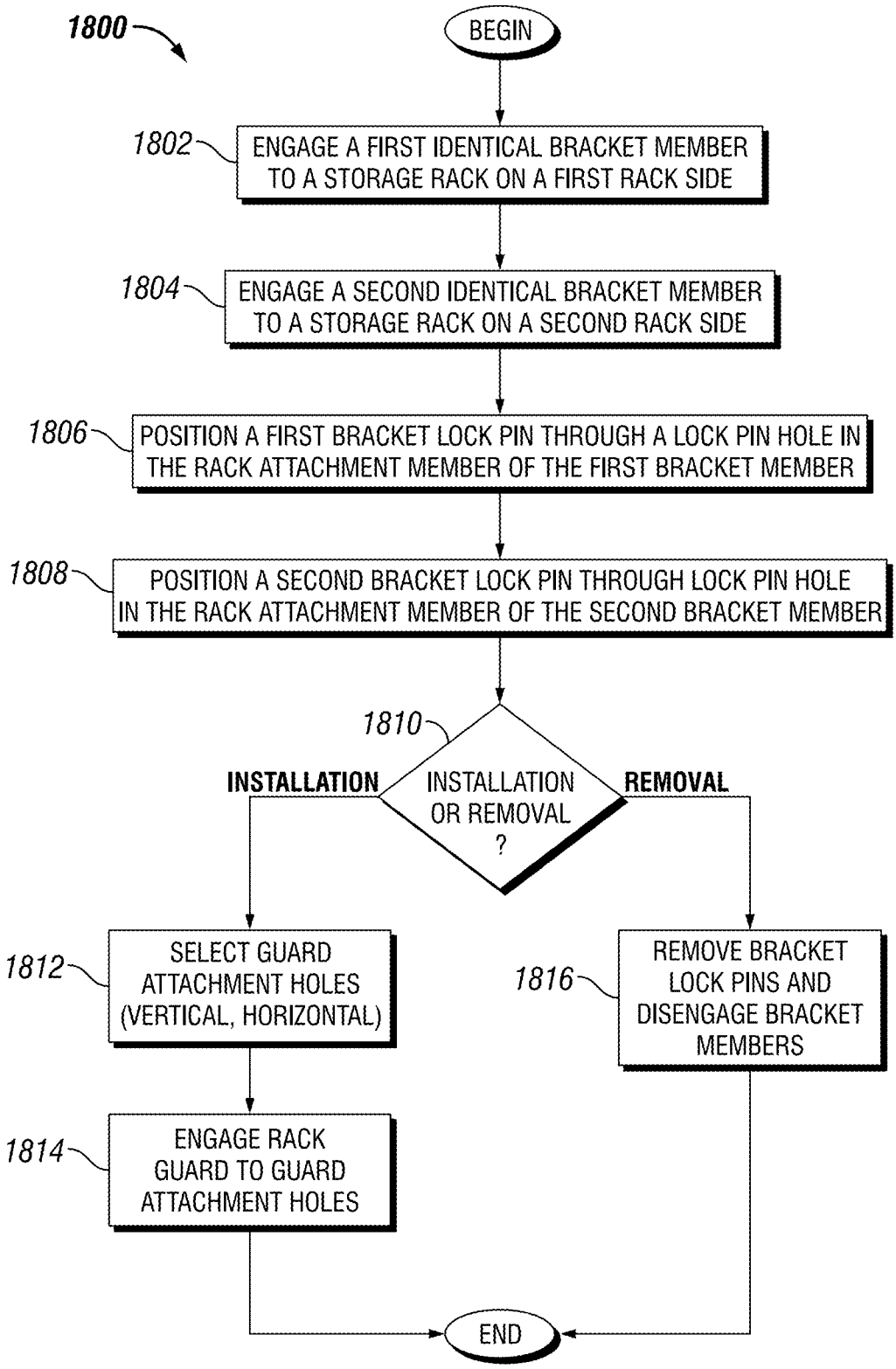
FIG. 18 is a schematic flow diagram of a procedure for installation and removal of a bracket.

Referencing FIG. 18, a procedure 1800 includes an operation 1802 to engage a first identical bracket member to a storage rack on a first rack side and an operation 1804 to engage a second identical bracket member to the storage rack on a second rack side. The identical bracket members may be configured according to any bracket 100 described herein, and the description of "identical bracket" with respect to the system 1500 is incorporated herein. Example engaging operations include positioning engagement tabs coupled to a rack attachment member of each bracket member through corresponding rack engagement features and sliding the bracket members down. The example procedure 1800 further includes an operation 1806 to position a first bracket lock pin through a lock pin hole in the rack attachment member of the first identical bracket member, and an operation 1808 to position a second bracket lock pin through a lock pin hole in the rack attachment member of the second identical bracket member. The bracket lock pins may be configured according to any description of a bracket lock pin 300 described herein. Example positioning operations 1806, 1808 include passing a stabilizing leg of each bracket lock pin through one of the rack engagement features also having an engagement tab of the rack attachment member of the bracket member positioned therein.

The example procedure 1800 further includes an operation 1810 to remove the brackets or to install a storage rack guard to the brackets. Where the operation 1810 is to install a storage rack guard, an example procedure 1800 includes an operation 1812 to select storage rack guard holes (e.g. guard attachment holes 112) to select a vertical and/or horizontal position of the storage rack guard, and an operation 1814 to engage the storage rack guard to the selected storage rack guard holes. In certain embodiments, for example where a storage rack guard attaches to a guard attachment member without the use of guard attachment holes, the operations to install a storage rack guard may differ from those presented in the example procedure 1800. Where the operation 1810 is to remove the brackets, the procedure 1800 includes an operation 1816 to remove each bracket lock pin and the second bracket lock pin, and to disengage each of the bracket members from the storage rack. In certain embodiments, during a full system installation or removal, for example, the brackets 100 may be installed directly to the rack with the storage rack guard already attached to the brackets 100, and/or the brackets 100 may be removed from the rack with the storage rack guard still attached.

Certain further non-limiting embodiments of the disclosure are described following.

An example apparatus includes a bracket having a rack attachment member, the rack attachment member adapted to interface with a rack, such as a storage rack. The example rack attachment member includes a flat surface, and has a width of about a rack vertical column width, a width of about half of a rack vertical column width, and/or having a length where two brackets can be mounted side by side on a rack vertical column. Example and non-limiting widths for the rack attachment member include less than 3", less than 1.5", 1⅜", and 1", and between 1" and 3", inclusive. The example rack attachment member further includes one or more rack engagement tabs, the tabs having a head that fits through a rack engagement feature on the rack vertical column (e.g. a hole in the column, and/or a teardrop hole in the column), and a stem such that, when the head is inserted through the rack engagement feature, the stem can rest on a lower portion of the rack engagement feature and a lip on the head can prevent the bracket from disengaging the rack vertical column. Example and non-limiting sizes for the head include an ellipsoid or elongated rectangle head having a vertical dimension of less than 1", of greater than ¼", of about ½", of about ⅝", of about ¾", and between ¼" and 1" inclusive; and a horizontal dimension of less than 1", of greater than ¼", of about ⅜", of about ½", of about ⅝", of about ¾", and between ¼" and 1" inclusive. The size and shape of the head may be anything configured to fit through the rack vertical column engagement feature and having a lip to secure the bracket. Example and non-limiting sizes for the stem include a width (e.g. diameter, characteristic length, greatest axis dimension, or other width description) less than ¾" inclusive, less than ⅝" inclusive, less than ½" inclusive, greater than ¼" inclusive, greater than ½" inclusive, and greater than ⅝" inclusive. The stem width accommodates setting the engagement tab in the lower portion of the rack engagement feature, and providing for the geometry of the lower lip of the head. In certain embodiments, the width of the stem may be the same as or greater than the width of the head (e.g. where the head is partially offset from the stem, providing the lip even where the stem is of the same or greater size). The selection of the stem shape and size may be made to accommodate the particular contemplated apparatus.

An example rack attachment member further includes one or more holes to provide access to the rack engagement feature. An example hole is positioned on the rack attachment member such that, when the bracket is installed on the rack, the hole provides sufficient access into a rack engagement feature engaged with one or both of the engagement tabs, where the bracket lock pin can be positioned through the hole. Example holes include a hole above the lower one of the engagement tabs, and/or a hole above the upper one of the engagement tabs. An example rack attachment member includes more than one hole, to allow for the usage of either the upper or lower one of the engagement tabs, or both of the engagement tabs, and/or to provide for right-left reversibility of the bracket. The cross-sectional area of the hole may be entirely within the rack engagement feature, and/or may extend above the rack engagement feature, with sufficient room of the hole provided within the profile of the rack engagement feature to allow the bracket lock pin to be positioned therein. An example hole on the rack attachment member includes a circular hole having a diameter of 0.5", and positioned with a center 1⅛" vertically from a top or bottom edge of the rack attachment member. An example rack attachment member includes two holes, each positioned with a center 1⅛" from a vertically closest edge of the rack attachment member for the corresponding hole. Example and non-limiting embodiments include holes having a shape other than a circular shape, and having a diameter or characteristic length between 0.25" and 1" inclusive, and/or including a portion of a more complex shape, where the portion includes a sufficient geometry to accommodate the insertion of the bracket lock pin. The one or more holes on the rack attachment member may be positioned between the engagement tabs (e.g. when the vertically lower one of the engagement tabs is contained with the bracket lock pin), and/or outside the engagement tabs (e.g. when the vertically higher one of the engagement tabs is contained with the bracket lock pin). The one or more holes may be positioned at any distance vertically from the top or bottom edge of the rack attachment member, and vertical positioning may be determined relative to a closest portion of the hole to the corresponding vertical edge, to a center portion of the hole, and/or to a selected portion of the hole within the geometry of the hole (e.g. a portion of the hole intended to accommodate the bracket lock pin).

The example apparatus further includes a guard attachment member structured for affixing a selected rack protection element thereto. An example guard attachment member includes a desired length and at least one mounting feature, such as one or more holes or tabs provided on and/or defined by the guard attachment member. An example mounting feature includes a shape of the guard attachment member provided such that a rack guard attaches directly to the guard attachment member, for example clipping on, resting on, or otherwise bodily attaching to the guard attachment member. An example guard attachment member includes six holes defined thereupon, and positioned away from the rack attachment member, a first pair at 7.25 inches, a second pair positioned at 9.25 inches, and a third pair positioned at 11.25 inches. Each pair of holes of the example guard attachment member includes two vertically aligned holes, each positioned in an evenly spaced manner vertically relative to the guard attachment member. Any number and arrangement of holes, and/or guard attachment members having no holes are contemplated herein.

The example apparatus further includes a lock pin 300 having a stabilizing leg coupled to a lock pin head. The example lock pin includes a coupling member between the lock pin head in the stabilizing leg, wherein the coupling member has a length extending from the lock pin head to the stabilizing leg. In certain embodiments, the coupling member is included as a portion of the stabilizing leg, and or the stabilizing leg is a continuation of the material forming the coupling member. An example lock pin is formed from a straight rod coupled to the lock pin head, where the stabilizing leg is thereby formed by bending the straight rod at a selected location. In certain embodiments the stabilizing leg has a length of 1.75 inches in a diameter of 0.3 inches. An example lock pin head has a diameter of 0.75 inches, and a thickness of 0.125 inches. In certain embodiments, the coupling member has a length of about 1 inch, less than 1 inch, about 1.05 inches less the thickness of the lock pin head, and/or a length of about 0.925 inches. In certain embodiments, the coupling member is considered as part of the stabilizing leg, and in certain embodiments the coupling member is considered as a separate portion of the lock pin. In certain embodiments the lock pin does not include a coupling member, and the stabilizing leg is directly coupled to the lock pin head.

While the invention has been disclosed in connection with the certain embodiments shown and described in detail, various modifications and improvements thereon will become readily apparent to those skilled in the art having the benefit of the disclosure herein. Accordingly, the spirit and scope of the present invention is not to be limited by the foregoing examples, but is to be understood in the broadest sense allowable by law.

All documents referenced herein are hereby incorporated by reference in the entirety for all purposes.

What is claimed is:

1. An apparatus, comprising:

a bracket having a rack attachment member and a guard attachment member;

an upper rack engagement tab and a lower rack engagement tab;

a lock pin hole defined by the rack attachment member and structured to receive a lock pin having a stabilizing leg coupled to a lock pin head; and an additional lock pin hole defined by the rack attachment member and structured to receive the lock pin, wherein:

each engagement tab is coupled to the rack attachment member, each engagement tab includes a stem portion coupled to the rack attachment member and a head portion having a greater cross-sectional area than the stem portion, the guard attachment member defines a guard attachment hole positioned at a rack guard spacing distance from the rack attachment member, and the lock pin hole and the additional lock pin hole are structured such that the bracket is reversible so that at least one of the lock pin hole or the additional lock pin hole can receive the lock pin when the bracket is applied on a right side or a left side of a storage rack.

2. The apparatus of claim 1, wherein the lock pin hole is disposed between the upper rack engagement tab and the lower rack engagement tab.

3. The apparatus of claim 1, wherein the stabilizing leg has a geometry such that the lock pin head is urged toward the lock pin hole when the stabilizing leg is passed through the lock pin hole.

4. The apparatus of claim 1, wherein the guard attachment hole comprises a first guard attachment hole, and wherein the guard attachment member further defines a second guard attachment hole positioned vertically above the first guard attachment hole.

5. The apparatus of claim 4, wherein the guard attachment member comprises a horizontal center axis, and wherein each of the second guard attachment hole and the first guard attachment hole are positioned an equal vertical distance from the horizontal center axis.

6. The apparatus of claim 4, wherein the second guard attachment hole is positioned a guard mounting distance from a top edge of the guard attachment member, and wherein the first guard attachment hole is positioned the guard mounting distance from a bottom edge of the guard attachment member.

7. The apparatus of claim 4, wherein the first guard attachment hole and the second guard attachment hole comprise a first pair of vertically aligned holes, and wherein the guard attachment member further comprises at least one additional pair of vertically aligned holes.

8. The apparatus of claim 1, wherein the lock pin hole is sized and positioned such that the lock pin hole provides sufficient cross-sectional area within a rack engagement distance that comprises a vertical extent of a rack column hole.

9. The apparatus of claim 8, wherein the rack column hole comprises a teardrop storage rack hole.

10. The apparatus of claim 1, wherein the guard attachment member forms a perpendicular angle with the rack attachment member.

11. The apparatus of claim 1, wherein a portion of the guard attachment member defining the guard attachment hole further defines a first plane, wherein the rack attachment member further defines a second plane, and wherein the first plane is perpendicular to the second plane.

12. An apparatus, comprising:

a bracket having a rack attachment member and a guard attachment member;

an upper rack engagement tab and a lower rack engagement tab; and a lock pin hole defined by the rack attachment member and structured to receive a lock pin having a stabilizing leg coupled to a lock pin head, wherein:

each engagement tab is coupled to the rack attachment member, each engagement tab includes a stem portion coupled to the rack attachment member and a head portion having a greater cross-sectional area than the stem portion, the guard attachment member defines a guard attachment hole positioned at a rack guard spacing distance from the rack attachment member, and the stabilizing leg has a geometry such that the lock pin head is urged toward the lock pin hole when the stabilizing leg is passed through the lock pin hole.

13. The apparatus of claim 12, wherein the lock pin hole is disposed between the upper rack engagement tab and the lower rack engagement tab.

14. The apparatus of claim 12, wherein the guard attachment hole comprises a first guard attachment hole, and wherein the guard attachment member further defines a second guard attachment hole positioned vertically above the first guard attachment hole.

15. The apparatus of claim 14, wherein the guard attachment member comprises a horizontal center axis, and wherein each of the second guard attachment hole and the first guard attachment hole are positioned an equal vertical distance from the horizontal center axis.

16. The apparatus of claim 14, wherein the second guard attachment hole is positioned a guard mounting distance from a top edge of the guard attachment member, and wherein the first guard attachment hole is positioned the guard mounting distance from a bottom edge of the guard attachment member.

17. The apparatus of claim 14, wherein the first guard attachment hole and the second guard attachment hole comprise a first pair of vertically aligned holes, and wherein the guard attachment member further comprises at least one additional pair of vertically aligned holes.

18. The apparatus of claim 12, wherein the lock pin hole is sized and positioned such that the lock pin hole provides sufficient cross-sectional area within a rack engagement distance that comprises a vertical extent of a rack column hole.

19. The apparatus of claim 18, wherein the rack column hole comprises a teardrop storage rack hole.

20. The apparatus of claim 12, wherein the guard attachment member forms a perpendicular angle with the rack attachment member.

* * * * *